US010723591B2

(12) United States Patent
Kirsch et al.

(10) Patent No.: US 10,723,591 B2
(45) Date of Patent: Jul. 28, 2020

(54) GUIDE RAIL FOR AN ELEVATOR SYSTEM

(71) Applicants: THYSSENKRUPP ELEVATOR AG, Essen (DE); thyssenkrupp AG, Essen (DE)

(72) Inventors: Michael Kirsch, Kirchheim unter Teck (DE); Walter Hoffmann, Niedernhausen (DE); Thomas Kuczera, Leinfelden-Echterdingen (DE); Philippe Gainche, Großbettlingen (DE); Mike Obert, Gernsbach (DE); Markan Lovric, Stuttgart (DE); Martin Madera, Neuhausen (DE); Martin Krieg, Gaggenau (DE)

(73) Assignee: THYSSENKRUPP ELEVATOR INNOVATION AND OPERATIONS GMBH, Essen (DE)

( * ) Notice: Subject to any disclaimer, the term of this patent is extended or adjusted under 35 U.S.C. 154(b) by 205 days.

(21) Appl. No.: 15/564,453

(22) PCT Filed: Apr. 8, 2016

(86) PCT No.: PCT/EP2016/057716
§ 371 (c)(1),
(2) Date: Oct. 5, 2017

(87) PCT Pub. No.: WO2016/113434
PCT Pub. Date: Jul. 21, 2016

(65) Prior Publication Data

US 2018/0079624 A1 Mar. 22, 2018

(30) Foreign Application Priority Data

Apr. 9, 2015 (DE) ..... 10 2015 206 345

(51) Int. Cl.
*B66B 7/02* (2006.01)
*B66B 11/04* (2006.01)

(52) U.S. Cl.
CPC ..... *B66B 7/026* (2013.01); *B66B 7/023* (2013.01); *B66B 7/024* (2013.01); *B66B 11/0407* (2013.01)

(58) Field of Classification Search
CPC ..... B66B 7/026; B66B 7/023; B66B 11/0407
See application file for complete search history.

(56) References Cited

U.S. PATENT DOCUMENTS 4,079,817 A * 3/1978 Tosato ..... B66B 7/02 187/408
6,991,070 B1 * 1/2006 Sanz Gamboa ..... B66B 7/02 187/406

(Continued)

FOREIGN PATENT DOCUMENTS

CN 2112648 U 8/1992
CN 101186263 A 5/2008

(Continued)

OTHER PUBLICATIONS

JP02-037069 Machine Translation (Year: 1990).*

(Continued)

*Primary Examiner* — Michael A Riegelman
(74) *Attorney, Agent, or Firm* — thyssenkrupp North America, LLC

(57) ABSTRACT

A guide rail for an elevator system may comprise at least two rail elements that together form a guide rail portion having a functional running track that extends in a travel direction. Each of the rail elements may be connected to a shaft wall of the elevator system. Furthermore, the at least two rail elements may be adjacent and spaced such that the at least two rail elements can thermally expand freely in the travel direction. Additionally, the at least two rail elements in a (Continued)

region of the functional running track may have mutually opposite borders that have complementary profiles. An arbitrary cross section of the guide rail portion perpendicular to the travel direction in the region of the functional track may run through at least one of the two adjacent rail elements.

9 Claims, 8 Drawing Sheets

(56) References Cited

U.S. PATENT DOCUMENTS

| | | | | |
|---|---|---|---|---|
| 2002/0073875 | A1* | 6/2002 | Liew | E01B 11/24 104/122 |
| 2012/0263554 | A1* | 10/2012 | Sanz Gamboa | B66B 7/026 411/81 |
| 2012/0312640 | A1* | 12/2012 | Bjorni | B66B 7/024 187/408 |
| 2013/0056310 | A1* | 3/2013 | Bjorni | B66B 7/022 187/359 |
| 2016/0083222 | A1* | 3/2016 | Fernandez | B66B 19/002 187/406 |
| 2017/0297867 | A1* | 10/2017 | Fauconnet | B66B 7/024 |
| 2018/0009633 | A1* | 1/2018 | Fargo | B66B 19/002 |
| 2018/0079624 | A1* | 3/2018 | Kirsch | B66B 7/024 |
| 2018/0170712 | A1* | 6/2018 | Fauconnet | B66B 7/025 |
| 2018/0297815 | A1* | 10/2018 | Kirsch | B66B 19/002 |
| 2019/0055108 | A1* | 2/2019 | Fauconnet | B33Y 80/00 |

FOREIGN PATENT DOCUMENTS

| | | | |
|---|---|---|---|
| DE | 1185352 | A | 1/1965 |
| EP | 0502613 | A | 9/1992 |
| JP | H02037069 | A | 2/1990 |
| JP | H04317979 | A | 11/1992 |
| JP | 0648672 | H | 2/1994 |
| JP | H0648672 | A | 2/1994 |
| JP | H1023747 | A | 1/1998 |
| JP | H1029778 | A | 2/1998 |
| JP | 1029778 | A | 3/1998 |
| WO | 2011102008 | A | 8/2011 |
| WO | 2012/045606 | A1 | 4/2012 |
| WO | 2012045606 | A | 4/2012 |

OTHER PUBLICATIONS

JPH1029778A Machine Translation (Year: 1996).*
English Translation of International Search Report issued in PCT/EP2016/057716, dated Jun. 30, 2016 (dated Jul. 12, 2016).
English Machine Translation of DE1185352A.
English Abstract of JPH1023747A.
English Abstract of JPH04317979A.
English Abstract of JPH0648672A.

* cited by examiner

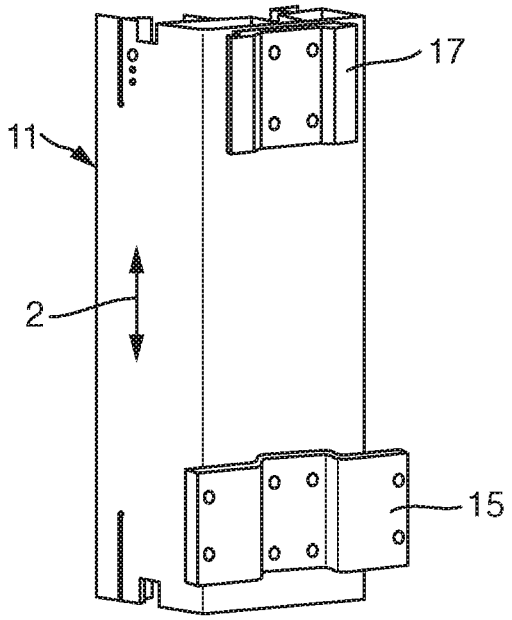
Fig. 2a
Fig. 2b
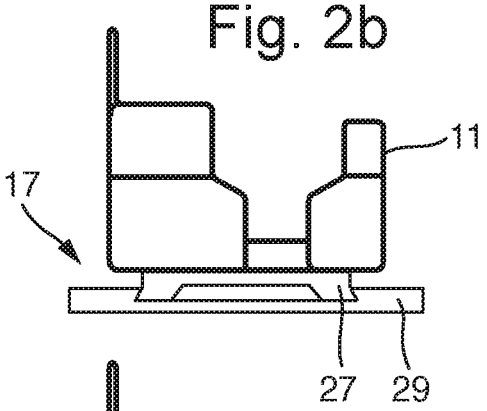
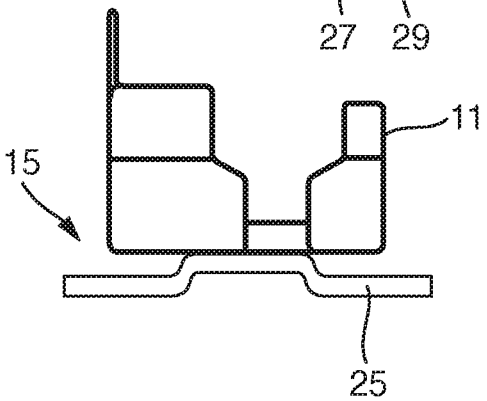
Fig. 2c

GUIDE RAIL FOR AN ELEVATOR SYSTEM

CROSS REFERENCE TO RELATED APPLICATIONS

This application is a U.S. National Stage Entry of International Patent Application Serial Number PCT/EP2016/057716, filed Apr. 8, 2016, which claims priority to German Patent Application No. DE 10 2015 206 345.3 filed Apr. 9, 2015, the entire contents of both of which are incorporated herein by reference.

FIELD

The present disclosure generally relates to elevator systems, including guide rails in elevator systems that reduce noise and vibration.

BACKGROUND

Guide rails are used in elevator systems in order for elevator cars to be guided along an elevator shaft. The elevator shafts herein traditionally extend vertically in a building. However, horizontal shafts have also already been proposed in some instances. By virtue of the great lengths of shafts, the guide rails during fitting are typically assembled from individual rail elements.

In the fitting of the rail elements in vertical elevator shafts it has become accepted practice for the rail elements to be stacked on top of one another and for said rail elements to be fixed to the shaft wall only in the horizontal direction. This has the advantage that the rail elements along the vertical travel direction abut one another, this simultaneously enabling an expansion of the guide rail in the vertical direction in the case of temperature variations. The assembled guide rail thus behaves like a continuous guide rail.

A new type of elevator system such as is described in WO 2012/045606, for example, uses a linear motor for driving the elevator cars within the elevator shaft. A primary part of the linear motor herein is attached to the rail elements, and a secondary part of the linear motor is attached to the elevator car to be moved. This type of drive enables a plurality of elevator cars to be displaced simultaneously and in a mutually independent manner in the same shaft.

However, there are significant technical issues pertaining to the guide rails that are derived from the above. On the one hand, guide rails are to be equipped with the primary part of the linear motor. This additional weight has to be received by guide rails. On the other hand, there are no cables present in the case of this type of elevator, such that also all vertical forces (weight of the car, driving force of the car, braking forces) that act on the car have to be received by the guide rails. Moreover, since a multiplicity of cars operate in the same shaft, the proportion of said forces is also multiplied.

By virtue of this increased stress the concept of the stacked rail elements is no longer practically implementable since the lowermost rail elements can no longer absorb the load of the rail elements lying thereabove. Consequently, the rail elements must be individually connected to the shaft wall.

However, the drive concept of the linear motor leads to yet a further issue. As is also the case with other electric motors, the primary part inter alia heats up during operation. Since the primary part is attached to the rail elements, the heat is dissipated to the rail elements, on account of which a significantly higher thermal expansion results. In order for the latter to be taken into account, adjacent rail elements must have a mutual spacing (a so-called expansion joint).

Furthermore, subsidence also arises in the case of newly constructed buildings. Therefore, rail elements that are attached to the wall must have a mutual spacing that compensates for said subsidence. The gap width between the adjacent rail elements is reduced by the subsidence.

However, the individual components of the car slide along the guide rail in the operation of the elevator system. For example, one elevator car typically has a plurality of guide rollers which roll along a running track of the guide rail. Moreover, a shoe brake by way of which the elevator car is braked in that one or a plurality of brake shoes of the elevator car act(s) on the guide rail can be provided. As soon as components of this type switch between two adjacent rail elements, vibrations and noise are created by virtue of the spacing.

Thus a need exists to reduce these types of vibrations and noise.

BRIEF DESCRIPTION OF THE FIGURES

FIG. 2*a* is a perspective view of an example rail element.

FIG. 2*b* is a sectional view of the example rail element of FIG. 2*a*, including an example loose bearing.

FIG. 2*c* is a sectional view of the example rail element of FIG. 2*a*, including an example fixed bearing, with "FIG. 2" referring collectively to FIGS. 2*a*, 2*b*, and 2*c*.

DETAILED DESCRIPTION

Figure 1:
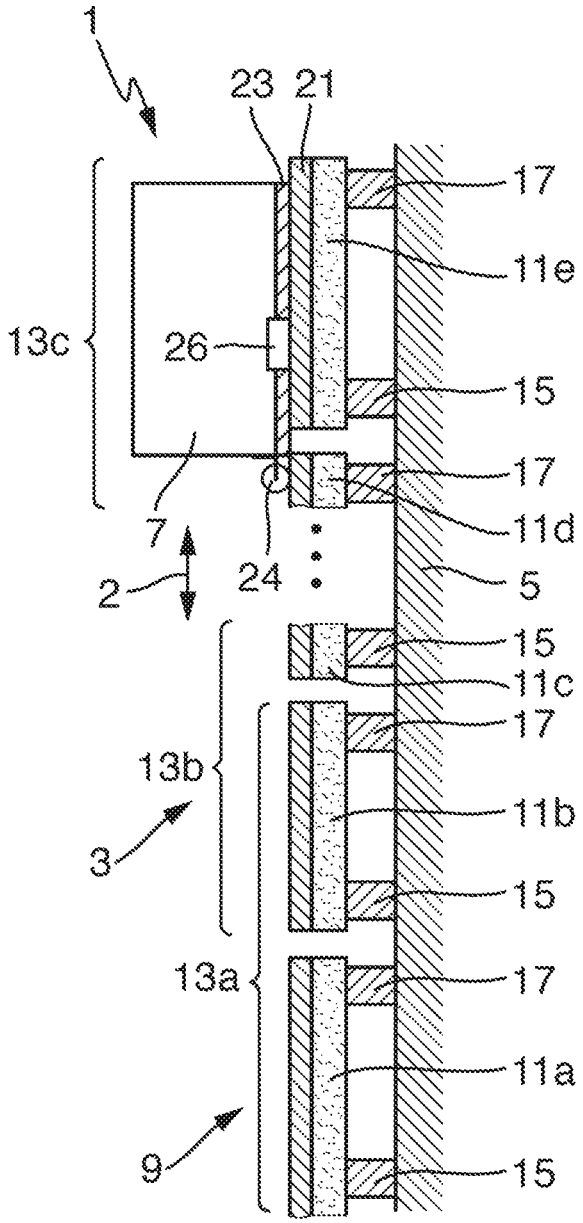
FIG. 1 is a schematic view of a fragment of an example elevator system.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art."

In some examples, a guide rail for an elevator system may comprise at least two rail elements which conjointly form one guide rail portion having a functional running track in a travel direction. Each of the rail elements herein is connected to the shaft wall, wherein adjacent rail elements have a mutual spacing such that the rail elements can thermally expand freely in the travel direction. Furthermore, at least two of the adjacent rail elements in the region of the functional running track have mutually opposite borders which have a complementary profile in such a manner that an arbitrary cross section of the guide rail portion perpendicular to the travel direction in the region of the functional track runs through at least one of the two adjacent rail elements.

This has the advantage that the adjacent rail elements in the region of the functional running track are adapted to one another in order for a uniform and steady transition of components rolling or sliding along to be guaranteed.

A functional running track in the context of this application is understood to be that region of the guide rail along which the respective components slide, scrape, or roll in the operation of the elevator system.

In the case of one preferred variant of the invention, the functional running track is a rolling track for a guide roller of an elevator car. In the case of a guide roller the invention guarantees in particular that the guide rollers maintains permanent contact with the guide rail. There is no jumping at the transition points of rail elements that could cause oscillations or noises.

The arbitrary cross section perpendicular to the travel direction herein in the region of the rolling track preferably has an expansion which corresponds to at least 20% of the expansion of the rolling track in a manner perpendicular to the travel direction. This has the advantage that a sufficiently intensive contact is present between the guide roller and the guide rail. A rolling guide roller contacts the guide rail along a line which corresponds to a cross section perpendicular to the travel direction. A cross section of more than 20% of the expansion of the rolling track thus leads to at least 20% of the potential contact face of the guide roller being in contact with the guide rail.

In the case of one refinement of the invention, the two adjacent rail elements in the region of the rolling track have mutually meshing comb-shaped moldings. On the one hand, this design embodiment enables a thermal expansion of adjacent rail elements in that the comb-shaped moldings of the two adjacent rail elements slide into one another in the case of a thermal expansion. On the other hand, a positive contact with the guide roller is guaranteed. The guide roller when rolling is thus at all times in contact with all comb-shaped moldings of at least one rail element. The contact regions between the guide roller and the elevator rail are thus at all times distributed across the entire width of the guide roller. The guide roller bears on said guide rail not only on the left or the right. This leads to the guide roller rolling in a particularly uniform manner.

In one special design embodiment, a first rail element of the at least two rail elements has a first bolt on which a plurality of first plates which form the comb-shaped moldings of the first rail element are sequentially disposed. Furthermore, a second rail element of the at least two adjacent rail elements has a second bolt on which a second plurality of second plates which form the comb-shaped moldings of the second rail element are sequentially disposed. This construction has the advantage that the individual components such as, for example, the first and the second plates, can be made separately in a cost-effective manner. The rail element per se can thus be embodied in a relatively simple manner. The more complex comb-shaped moldings can be produced separately and be retro-fitted. The first and the second bolt herein are typically aligned so as to be mutually parallel.

In the case of one refined variant, the first plurality of plates each have an elongate bore through which the second bolt extends, and the second plurality of plates each have an elongate bore through which the first bolt extends. The comb-shaped moldings thus not only mesh with one another but a form-fitting connection between the rail elements is also established. To this end, the first rail element is connected to the first plates and to the second plates by way of the first bolt. Furthermore, the first plates and the second plates are additionally connected to the second rail element by way of the second bolt.

In particular, first plates and second plates herein are sequentially disposed in an alternating manner of each of the two bolts. This leads to the contact regions between the guide roller and the elevator rail being distributed uniformly across the entire width of the guide roller at each cross section.

In particular, the first plates are furthermore rotatably disposed on the first and the second bolt, and the second plates are rotatably disposed on the first and the second bolt. On account thereof, inaccuracies in the fitting of the rail elements can be compensated for. It can arise during fitting that adjacent rail elements do not mutually align to the fullest extent but that the latter have a minimum mutual offset. This can result in the rolling track on the first rail element having a somewhat greater spacing from the elevator car than the rolling track on the second rail element, for example. A step-type offset would thus be present along the rolling track, which would lead to undesirable noises as the guide rollers roll along. This can be compensated for by the rotatable arrangement of the plates on the bolts. If a fitting-related offset as described above is present, the stack formed from the first and the second plates is automatically placed so as to be oblique, thus equalizing the offset along the rolling track. A consistent running track which facilitates quiet rolling thus results.

In the case of a special design embodiment, the first and the second plates are oriented and disposed such that the narrow sides of the first and the second plates conjointly form part of the functional running track of the guide rail portion. This enables a particularly simple and compact construction mode, and simultaneously a particularly uniform distribution of the contact regions between the guide roller and the elevator rail across the entire width of the guide roller at each cross section.

In the case of alternative design embodiments of the invention, the mutually opposite borders have a step-shaped profile, or the mutually opposite borders run at an angle of less than 70° in relation to the travel direction. This likewise has the advantage that a sufficiently intensive contact is present between the guide roller and one of the rail elements of the guide rail. These design embodiments at the same time have the additional advantage that the two rail elements can be pivoted in relation to one another. Mutual pivoting of the rail elements is helpful when the travel direction of an elevator car is to be changed from vertical travel to horizontal travel. In the case of specific variants used for implementing a change of direction of this type, this can be enabled by pivoting rail elements. An example thereof is to be found in JPH0648672.

In the case of one refined variant, the mutually opposite borders in the region of the functional running track have a chamfer or a curvature. On account thereof, a funnel-shaped profile along the functional running track results. This has the advantage that the abutting edges in the case of a less-than-ideal setting of the rail elements following a pivoting procedure are reduced. For example, a certain offset between the adjacent rail elements, or an incline between adjacent rail elements, may arise.

In the case of a further alternative design embodiment of the invention, the functional running track is a braking track for a shoe brake of an elevator car. A braking track is understood to be that region of the guide rail along which a brake shoe of a shoe brake which acts between the elevator car and the guide rail scrapes along during the braking procedure.

In the case of this variant, one of the at least two adjacent rail elements can have a pin which engages in an assigned blind bore of the other rail element of the at least two adjacent rail elements. The two rail elements are connected in the region of the braking track, so to speak.

In the case of a braking procedure, a shoe brake acts on the guide rail in the region of the braking track. This leads to a certain deformation of the guide rail in this region. The braking distance of the elevator car in many cases extends across a plurality of consecutive rail elements. As long as the shoe brake acts only on one rail element and not on the adjacent rail element, a deformation of the first-mentioned rail element but not a deformation of the adjacent rail element would accordingly take place without the pins. A uniform braking procedure could consequently not be guaranteed since an offset of the rail elements in the region of the braking track is created on account of the braking action. The pins which engage in the blind bores lead to the deformation being transmitted also to the adjacent rail element, even when the shoe brake does not yet act directly on the adjacent rail element. A uniform and consistent profile of the braking track is thus guaranteed.

In order for the above to be still amplified, in a manner adjacent to the braking track, a cut can be provided in the adjacent rail elements in order for the rigidity of the two rail elements in the region of the braking track to be reduced. An even more uniform transition between the rail elements in the region of the braking track is thus achieved.

In the case of a further alternative design embodiment for achieving the object, the guide rail comprises at least two rail elements which conjointly form one guide rail portion having a functional running track in a travel direction. Each of the rail elements herein is connected to the shaft wall, and adjacent rail elements have a mutual spacing such that the rail elements can thermally expand freely in the travel direction. Furthermore, a wedge-shaped transition piece which is mounted so as to be movable in a manner perpendicular to the travel direction is disposed between the two adjacent rail elements.

This has the advantage that a uniform and consistent transition results at all times for components that roll or slide along. As soon as the adjacent rail elements thermally expand such that the mutual spacing of the two rail elements is reduced, a force which leads to the wedge-shaped transition piece being expelled counter to the wedge direction is exerted on the wedge-shaped transition piece.

In the context of this application, the direction toward the sharp end of the wedge-shaped transition piece is referred to as the wedge direction, said direction running along the bisectrix of the wedge angle of the wedge-shaped transition piece.

By expelling the wedge-shaped transition piece it is guaranteed that the two adjacent rail elements can thermally expand in the travel direction. At the same time, the three elements (rail element, transition piece, rail element) that are sequentially disposed in the travel direction are always in abutment such that a consistent transition without a gap results.

Preferably, at least two of the adjacent rail elements in the region of the functional running track have mutually opposite borders which are rectilinear and enclose an angle which corresponds to the wedge angle of the wedge-shaped transition piece. A smooth transition between the adjacent rail elements and the transition piece is achieved in this way, since the wedge-shaped transition pieced fits precisely into the intermediate space between the adjacent rail elements.

The function running track particularly preferably extends across the wedge-shaped transition piece. Independently of whether the wedge-shaped transition piece is inserted or expelled, the functional running track in particular by way of the entire width bears on the wedge-shaped transition piece.

In one refined variant, the wedge direction runs at an angle which is between 70° and 110° in relation to the travel direction. The angle in relation to the travel direction is in particular 90°. The wedge angle is preferably in the range from 50° to 70°. The wedge-shaped transition piece can be oriented in a symmetrical manner such that both sides that adjoin the adjacent rail elements have the same and in particular acute angle in relation to the travel direction. Alternatively, the wedge-shaped transition piece can also be oriented in an asymmetrical manner. For example, one of the two faces can run at an angle of 90° in relation to the travel direction, and the other side can run at an angle in relation to the travel direction. It is important only that sliding in a manner transverse to the travel direction is enabled. The angled regions have the advantage that the wedge-shaped transition piece in the expansion of the adjacent rail elements is impinged with a sufficient force in order for the expulsion counter to the wedge-direction to be effected.

In one special embodiment, the wedge-shaped transition piece is mounted so as to be pretensioned counter to the wedge direction. This has the advantage that the wedge-shaped transition piece in a thermal contraction is automatically inserted by way of the pretension. The gap between the adjacent rail elements is enlarged in the thermal contraction such that the wedge-shaped transition piece can be inserted to a greater extent. The pretension ensures that this insertion is performed automatically.

The guide rail preferably comprises a compression spring which extends between the blunt end of the wedge-shaped transition piece and a holding installation. The compression spring enables the aforementioned pretensioning of the wedge-shaped transition piece counter to the wedge direction in a simple manner. To this end, the compression spring exerts a spring force on the wedge-shaped transition piece. This spring force herein has at least one force component acting in the wedge direction. The pretension of the wedge-shaped transition piece counter to the wedge direction results in this way.

In one refined embodiment, a guide is provided between at least one of the at least two rail elements and the wedge-shaped transition piece. The wedge-shaped transition piece is mounted so as to be movable along this guide. The guide ensures that the wedge-shaped transition piece in the case of a thermal variation of length of the rail elements carries out a well-defined translatory movement. Furthermore, the guide ensures that no offset is created between the one of the at least two rail elements and the wedge-shaped transition piece. Therefore, a uniform and consistent, functional running track is present also in the region of the transition between the at least one of the at least two rail elements and the wedge-shaped transition piece. In particular, in each case one guide is provided between two adjacent rail elements and the wedge-shaped transition piece disposed therebetween. The above-mentioned advantages are achieved on both transitions between a rail element and a wedge-shaped transition piece on account thereof.

In the case of one particular refinement, the guide is embodied as a tongue-and-groove connection. The latter is simple to produce and enables a reliable guiding behavior. Alternatively, a dovetail guide or a guide having a T-shaped cross section can also be used, for example. Guides of this type have the advantage that not only compressive forces but also tensile forces can be transmitted to the transition piece.

As soon as the adjacent rail elements thermally contract again such that the mutual spacing of the two rail elements is enlarged, a tensile force is exerted by way of the dovetail guide on the wedge-shaped transition piece which results in the wedge-shaped transition piece being expelled in the wedge direction. Pretensioning counter to the wedge direction can thus be dispensed with in the case of this variant. The specially designed guide leads to automatic expulsion and insertion.

FIG. 1 shows a schematic illustration of an elevator system 1. The latter comprises the shaft 3 which is delimited by the shaft walls, wherein for the purpose of clarity only a single shaft wall 5 is illustrated in the drawing. An elevator car 7 is displaceable along a guide rail 9 in a travel direction 2 in the shaft 3. The elevator car 7 has at least one guide roller 24 which during travel rolls on the guide rail 9. Furthermore, a shoe brake 26 is disposed between the elevator car 7 and the guide rail 9. Said shoe brake 26 brakes the elevator car 7 in that one or a plurality of brake shoes act on the guide rail 9.

The elevator car presently is displaceable in the vertical direction. However, the invention is not limited to this direction. The arrangement can also run horizontally or obliquely. Moreover, the invention is not limited to only one elevator car 7 being displaceable along the guide rail 9. It can also be provided that a plurality of elevator cars are displaceable in a mutually independent manner in the same shaft.

The guide rail 9 is assembled from rail elements 11*a*, 11*b*, 11*c*, 11*d*, 11*e*. Two adjacent rail elements 11*a*, 11*b*, 11*c*, 11*d*, 11*e* herein conjointly form one guide rail portion 13*a*, 13*b*, 13*c*. Rail elements 11*a*, 11*b*, 11*c*, 11*d*, 11*e* are in each case fastened to the shaft wall 5. To this end, each rail element 11*a*, 11*b*, 11*c*, 11*d*, 11*e* has one fixed bearing 15 and one loose bearing 17. While the rail elements 11*a*, 11*b*, 11*c*, 11*d*, 11*e* by way of the fixed bearing 15 are fixedly connected to the shaft wall 5 at least in the travel direction 2, the loose bearing 17 permits a movement of the rail elements 11*a*, 11*b*, 11*c*, 11*d*, 11*e* in the travel direction 2. The rail elements 11*a*, 11*b*, 11*c*, 11*d*, 11*e* can thus thermally expand freely in the travel direction 2 without any warping arising on account of the mounting on the shaft wall 5. Moreover, two adjacent rail elements 11*a*, 11*b*, 11*c*, 11*d*, 11*e* each have a spacing such that the rail elements can thermally expand freely in the travel direction 2. Details of the fixed bearing 15 and of the loose bearing 17 are illustrated in FIG. 2.

The elevator car 7 is driven with the aid of a linear motor. The linear motor 19 herein comprises primary parts 21 which are disposed on the rail elements 11*a*, 11*b*, 11*c*, 11*d*, 11*e*, and a secondary part 23 which is connected to the elevator cage. The rail elements 11*a*, 11*b*, 11*c*, 11*d*, 11*e* thus simultaneously form drive modules.

FIG. 2 shows a rail element 11 having one fixed bearing 15 and one loose bearing 17. A cross section through the rail element 11 in the region of the fixed bearing 15 (lower illustration) and in the region of the loose bearing 17 (upper illustration), respectively, is shown in each case in the right region of FIG. 2. The fixed bearing 15 comprises a first holder 25 which is fixedly connected to the rail element 11, on the one hand, and is fixedly connectable (for example, screw-fittable) to the shaft wall 5, on the other hand. The loose bearing 17 comprises a second holder 27 which is fixedly connected to the rail element 11. The second holder 27 is received in a form-fitting manner by a mount 29 in which the second holder 27 is movable only in one direction (perpendicular to the drawing plane). This direction after fitting corresponds to that direction in which the rail element 11 can thermally expand freely. The mount 29 in turn is fixedly connectable to the shaft wall 5.

Figure 3:
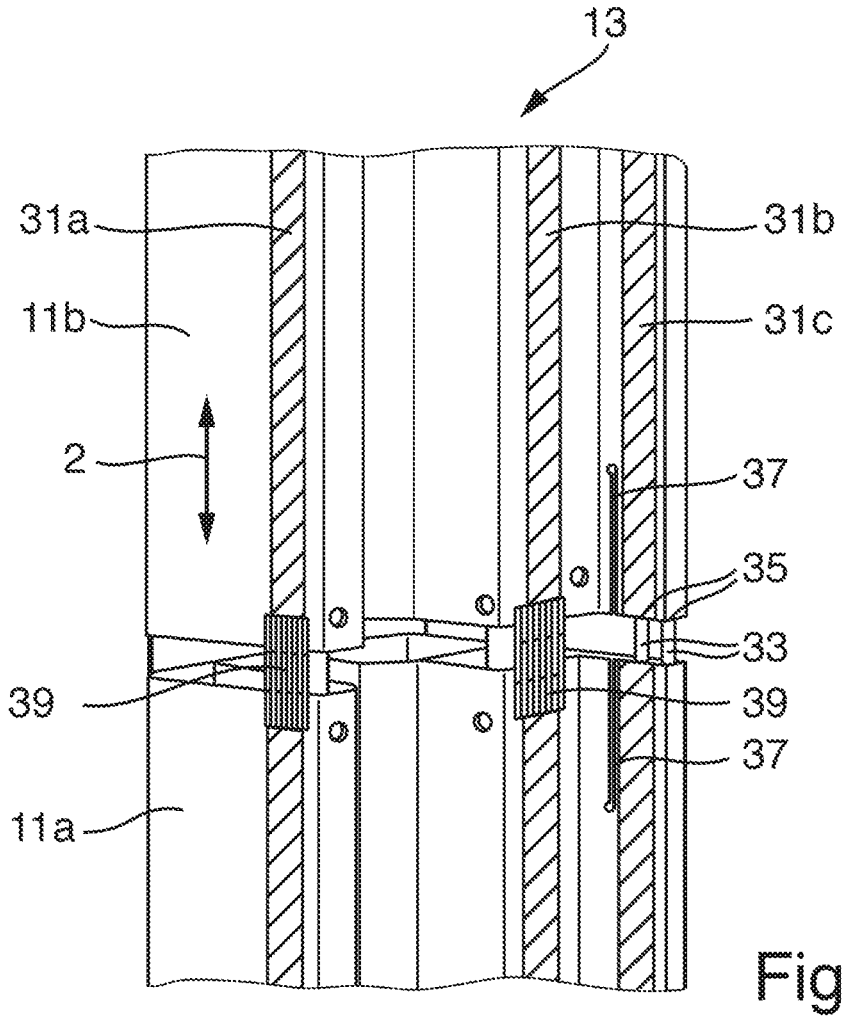
FIG. 3 is a perspective view of two adjacent rail elements.

FIG. 3 shows a design embodiment of a guide rail, having two different aspects of the invention. A fragment of a guide rail portion 13 is illustrated. Two rail elements 11*a*, 11*b* which conjointly form the guide rail portion 13 are shown. The rail elements 11*a* and 11*b* have a mutual spacing such that the rail elements 11*a* and 11*b* can thermally expand freely in the travel direction 2.

The guide rail portion 13 has a plurality of functional running tracks 31*a*, 31*b*, and 31*c*. The functional running tracks 31*a* and 31*b* are in each case a rolling track 31*a*, 31*b* for a guide roller of an elevator car 7. The functional running track 31*c* is a braking track 31*c* for a shoe brake of an elevator car 7. In the case of elevator cars having a linear drive it is typical for the brake to be disposed between the elevator car 7 and the guide rail 9, and for the braking force to be generated in that a shoe brake acts from the elevator car 7 on the guide rail 9.

The spacing between the adjacent rail elements 11*a* and 11*b* normally leads to an interruption in the functional running tracks 31*a*, 31*b*, and 31*c*. In order for said interruption to be compensated for, the rail elements 11*a* and 11*b* in the region of the functional running tracks 31*a*, 31*b*, and 31*c* are designed in a suitable manner. The rail elements 11*a* and 11*b* in the region of the functional running tracks 31*a*, 31*b*, and 31*c* thus have mutually opposite borders which have a complementary profile in such a manner that an arbitrary cross section of the guide rail portion in the region of the functional running track perpendicular to the travel direction 2 runs through at least one of the two adjacent rail elements 11*a* and 11*b*.

In the case of the aspect in the region of the braking track 31*c*, the rail element 11*a* has two pins 33 which engage in assigned blind bores 35 of the rail element 11*b*. The borders of the two rail elements 11*a* and 11*b* thus have a complementary profile. In a thermal expansion of the rail element 11*a* in the direction toward the adjacent element 11*b*, the pins 33 slide deeper into the blind bores 35. An arbitrary cross section of the guide rail portion perpendicular to the travel direction 2 in the region of the functional running track 31*c* runs either through the rail element 11*a* which also comprises the pins 33, or through the rail element 11*b*. The two rail elements 11*a* and 11*b* are connected in the region of the braking track 31*c*, so to speak. In the case of a braking procedure of the elevator car 7 a shoe brake acts on the guide rail 9 in the region of the braking track 31*c*. This leads to a certain deformation of the guide rail 9 in this region. In many cases, the braking distance of the elevator car 7 extends across a plurality of rail elements 11*a*, 11*b*. For example, the braking distance of an elevator car 7 traveling downward could start in the region of the rail element 11*b* and end in the region of the rail element 11*a*. As long as the shoe brake acts only on the rail element 11*b* and not on the rail element 11*a*, a deformation of the rail element 11*b* but not of the rail element 11*a* would therefore arise without the pins 33. A uniform braking procedure would consequently not be guaranteed since an offset of the rail elements 11*a* and 11*b* in the region of the braking track 31 is created by the braking action. The pins 33 which engage in the blind bores 35 lead to the deformation also being transmitted to the rail element 11*a*, despite the shoe brake acting only on the rail element 11*b*. A uniform and consistent profile of the braking track is thus guaranteed. In order for the above to be further amplified, in a manner adjacent to the braking track 31*c*, a cut 37 is provided in the adjacent rail elements 11*a*, 11*b* in order for the rigidity of the two rail elements 11*a*, 11*b* in the region of the braking track 31*c* to be reduced. An even more uniform transition between the rail elements 11*a*, 11*b* in the region of the braking track 31*c* is thus achieved.

A second aspect of the invention is likewise illustrated in FIG. 3. A transition element 39 is disposed in the region of the rolling track 31*a* as well as in the region of the rolling track 31*b*. The transition element 39 enables simultaneously a thermal expansion of the rail element 11*a* in the direction toward the adjacent rail element 11*b*, as well as trouble-free rolling of guide rollers of an elevator car 7 along the rolling tracks 31*a* and 31*b*. The exact construction of the transition element 39 will be explained hereunder by means of FIGS. 4 and 5.

Figure 4A:
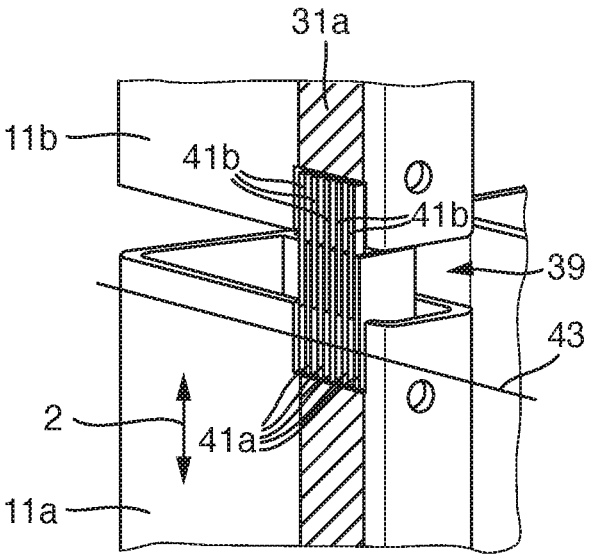
FIG. 4*a* is a detailed perspective view of two adjacent rail elements in a first state.
Figure 4B:
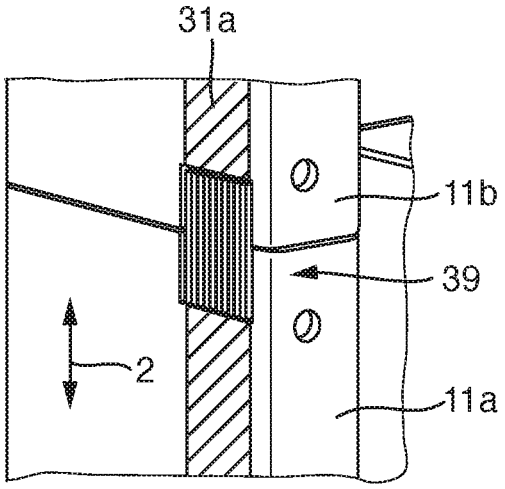
FIG. 4*b* is a detailed perspective view of two adjacent rail elements in a second state, with "FIG. 4" referring collectively to FIGS. 4*a* and 4*b*.

FIG. 4 shows a detailed illustration of the transition element in an installed state. A configuration in which there is still a significant spacing between a first rail element 11*a* and a second rail element 11*b* is illustrated in the left region of FIG. 4. By contrast, a thermal expansion of the first rail element 11*a* in the direction toward the adjacent second rail element 11*b* has already taken place in the right region of FIG. 4. The spacing between the rail elements 11*a* and 11*b* has been reduced. The first rail element 11*a* and the second rail element 11*b* in the region of the rolling track 31*a* have mutually opposite borders which have a mutually complementary profile. The first rail element 11*a* in the region of the rolling track 31*a* has comb-shaped moldings 41*a*. So as to be opposite thereto, the second rail element 11*b* likewise has comb-shaped moldings 41*b*. The two comb-shaped moldings 41*a* and 41*b* are mutually offset and mesh in one another such that the complementary profile of the borders results. In a thermal expansion, the comb-shaped moldings 41*a* and 41*b* slide into one another until the configuration that is illustrated in the right region of FIG. 4 results.

Independently of whether the rail elements 11*a* and 11*b* are in the configuration according to the left region of FIG. 4 or according to the right part of FIG. 4 or in an intermediate state, an arbitrary cross section of the guide rail portion perpendicular to the travel direction 2 in the region of the rolling track 31*a* runs through at least one of the two adjacent rail elements 11*a*, 11*b*. The two rail elements 11*a* and 11*b* are connected in the region of the rolling track 31*a*, so to speak, without a gap in which the rolling guide roller would lose contact with the rail elements 11*a* and 11*b* being able to result. The border is shaped in particular in such a manner that the arbitrary cross section perpendicular to the travel direction 2 in the region of the rolling track 31*a* has an expansion which corresponds to at least 20% of the expansion of the rolling track 31*a* in a manner perpendicular to the travel direction 2. In the case of the variant of embodiment shown, the expansion is almost 50% in the case of each cross section. For example, the cross section along the line 43 intersects the first rail element 11*a* in the region of the comb-shaped moldings 41*a*. The comb-shaped moldings in this cross section collectively have an expansion which corresponds to approximately 50% of the width of the rolling track. By virtue of the required gap dimensions between the comb-shaped moldings 41*a* and 41*b* the value is actually somewhat less than 50%. A guide roller that rolls along contacts the guide rail along a line which corresponds to a cross section that is perpendicular to the travel direction 2. Consequently, the guide roller at any given time contacts the guide rail across a region which corresponds to approximately 50% of the width of the guide roller (and thus of the rolling track 31*a*).

Figure 5:
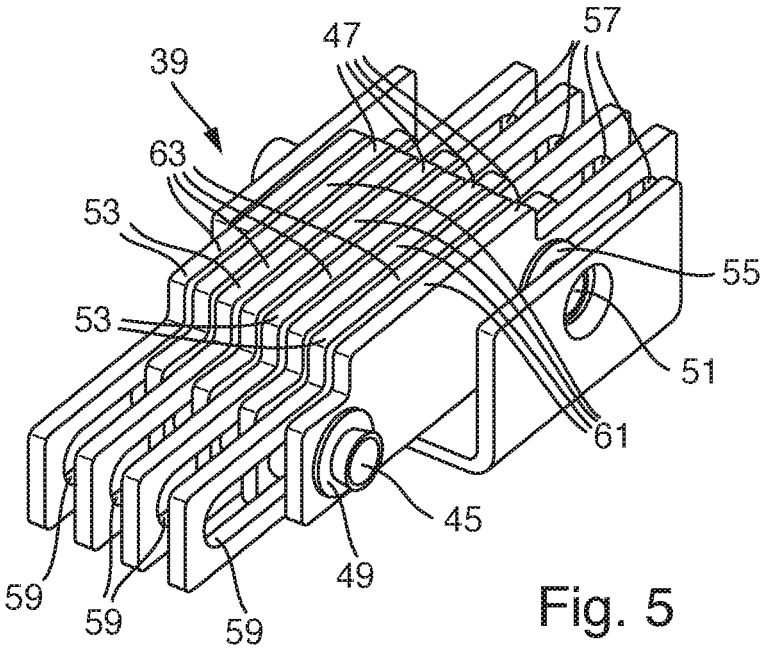
FIG. 5 is a perspective view of an example transition element in a non-installed state.

FIG. 5 shows a detailed illustration of the transition element 39 in the non-installed state. The transition element 39 comprises a first bolt 45 on which a plurality of first plates 47 are sequentially disposed. To this end, the first plates 47 have a bore 49 through which the first bolt 45 extends. The first plates 47 herein are rotatable about the first bore 45. In the installed state, the first bolt 45 and the first plates 47 are component parts of the first rail element 11*a* (cf. FIG. 4). The first plates 47 herein form the comb-shaped moldings 41*a* of the first rail element 11*a*. The transition element 39 furthermore comprises a second bolt 51 on which a plurality of second plates 53 are sequentially disposed. To this end, the second plates 53 have a bore 55 through which the second bolt 51 extends. The second plates 53 herein are rotatable about the second bolt 51. In the installed state, the second bolt 51 and the second plates 53 are component parts of the second rail element 11*b* (cf. FIG. 4). The second plates 53 herein form the comb-shaped moldings 41*b* of the second rail element 11*b*.

So as to be opposite the bore 49, the first plates 47 have an elongate bore 57 through which the second bolt 51 extends. Accordingly, so as to be opposite the bore 55, the second plates 53 have an elongate bore 59 through which the first bolt 45 extends. Accordingly, first plates 47 and second plates 53 are in each case sequentially disposed in an alternating manner on both bolts 45, 51, wherein in each case one bore 49, 55 and one elongate bore 57, 59 alternate with one another. This construction enables the spacing of the first bolts 45 and of the second bolt 51 to be variable. In the case of the illustration shown, the two bolts 45, 51 are at the minimum spacing thereof. If the spacing of the two bolts 45, 51 is enlarged, the first bolt 45 is thus displaced within the elongate bores 59, while the second bolt 51 is displaced within the elongate bores 57. Accordingly, the spacing of the two bolts 45, 51 can be enlarged until the two bolts 45, 51 are located at the end of their respective elongate bores 57, 59.

As can be seen by means of FIG. 4, the first plates 47 and the second plates 53 in the installed state are oriented and disposed such that the narrow sides 61 of the first plates 47 and the narrow sides 63 of the second plates 53 run along the functional running track 31, forming part of the functional running track 31*a*. The narrow sides 61 and 63 are thus substantially flush with the remaining functional running track 31*a*, such that a planar running surface for the guide rollers of the elevator car 7 results.

However, inaccuracies can also arise during fitting of the rail elements 11*a* and 11*b*, leading to the rail elements 11*a* and 11*b* not mutually aligning to the fullest extent but having a minimum mutual offset. This can result in the rolling track 31*a* on the first rail element having a somewhat greater spacing from the elevator car than the rolling track 31*a* on the second rail element, for example. A step-type offset would thus be present along the rolling track 31*a*, which would lead to undesirable noises as the guide rollers roll along. In order for this to be avoided, the first plates 47 are rotatably disposed on the first bolt 45 and on the second bolt 51. Accordingly, the second plates 53 are rotatably disposed on the first bolt 45 and on the second bolt 51. If an above-described fitting-related offset is present, the transition element 39 is automatically placed so as to be oblique, thus equalizing the offset along the rolling track 31*a*. A consistent rolling track 31*a* which facilitates quiet rolling thus results.

For simpler fitting, the transition element 39 is provided with an encompassing reinforcement element 65.

Figure 6A:
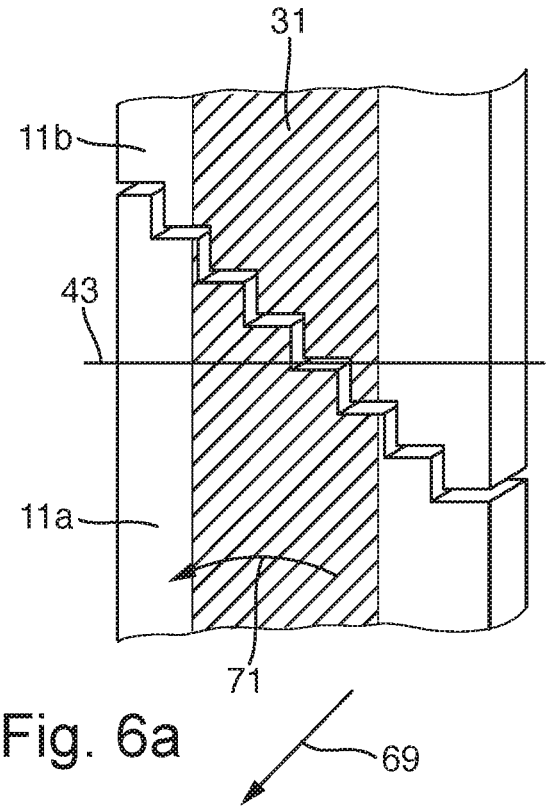
FIG. 6*a* is a schematic perspective view of additional example rail elements in a first state.
Figure 6B:
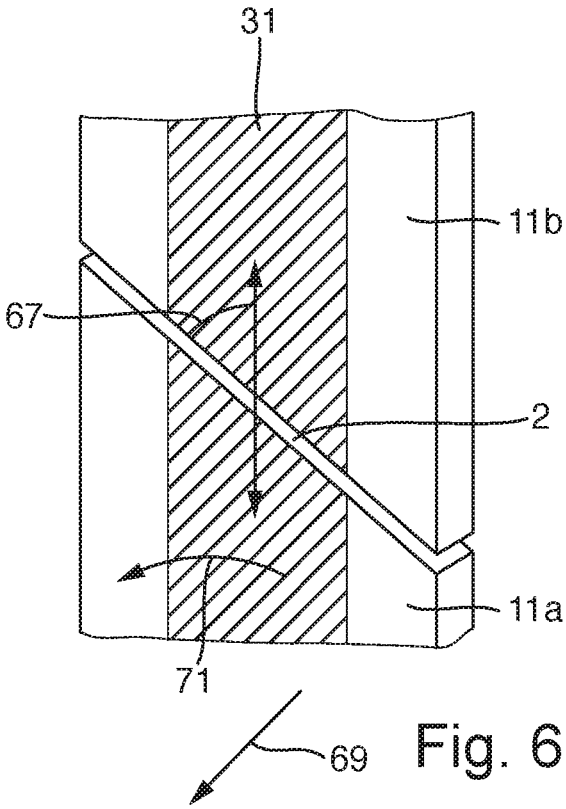
FIG. 6*b* is a schematic perspective view of additional example rail elements in a second state, with "FIG. 6" referring collectively to FIGS. 6*a* and 6*b*.

FIG. 6 schematically shows two further aspects of the invention. Two rail elements 11*a* and 11*b* having a functional running track 31*a* in a travel direction 2 are in each case shown in the left and the right region of FIG. 6. A spacing is present between the two adjacent rail elements 11*a* and 11*b*, such that the rail elements 11*a* and 11*b* can expand freely in the travel direction 2. The adjacent rail elements 11*a* and 11*b* in the region of the functional running track 31 have mutually opposite borders which have a complementary profile in such a manner that an arbitrary cross section of the guide rail portion perpendicular to the travel direction 2 in the region of the functional running track runs through at least one of the two adjacent rail elements 11*a* and 11*b*. The two rail elements 11*a* and 11*b* in the region of the functional running track are shaped such, so to speak, that no continuous gap perpendicular to the travel direction 2 results. In the case of a rolling track being a functional running track 31, the guide roller by virtue of a gap can thus not lose contact with the rail elements 11*a* and 11*b*. The border is in particular shaped such that the arbitrary cross section perpendicular to the travel direction 2 in the region of the running track has an expansion which corresponds to at least 20% of the expansion of the functional running track in a manner perpendicular to the travel direction 2.

The mutually opposite borders in the case of the left illustration have a step-shape profile, while a rectilinear profile having an angle 67 in relation to the travel direction is present in the right illustration.

In the case of the variant of embodiment illustrated on the left, the expansion is almost 75% in the case of each cross section. For example, the cross section along the line 43 intersects the first rail element 11*a* and the second rail element 11*b* such that approximately half of the width of the functional running track 31 is formed by the first rail element, and approximately a further quarter of the width of the functional running track is formed by the second rail element. In total, an expansion of approximately 75% of the total width of the functional running track thus results.

In the case of the variant of embodiment illustrated on the right, the angle 67 which is less than 70° ensures that any arbitrary cross section perpendicular to the travel direction 2 in the region of the functional running track 31 has an expansion which corresponds to at least 20% of the expansion of the functional running track 31 in a manner perpendicular to the travel direction 2.

Both variants of embodiment illustrated have the additional advantage that the two rail elements 11*a* and 11*b* can be pivoted in relation to one another. For example, the first rail element 11*a* in relation to the second rail element 11*b* can be pivoted about a rotation axis 69 in a direction 71. Mutual pivoting of the rail elements is helpful when the travel direction of an elevator car is to be changed from vertical travel to horizontal travel, for example. In the case of specific variants used for implementing a change of direction of this type, this can be enabled by pivoting rail elements. An example thereof is to be found in JPH0648672.

Figure 7:
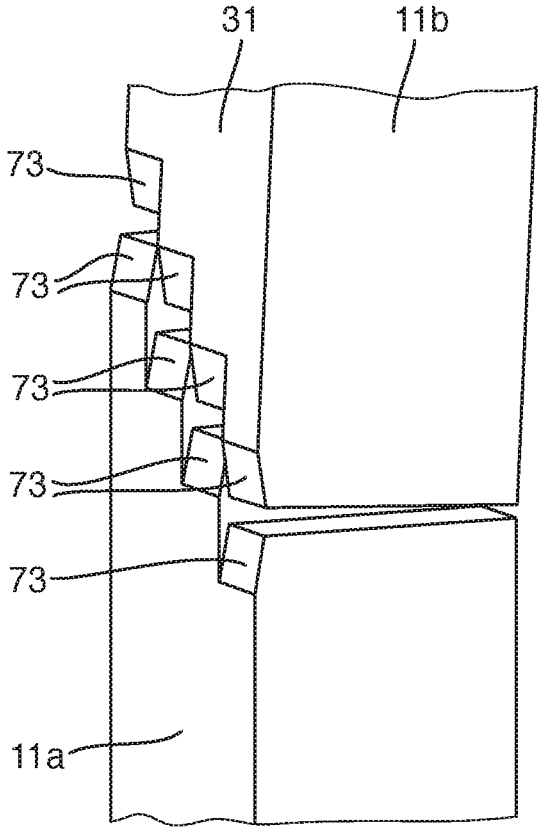
FIG. 7 is another perspective view of the example rail elements from the left side of FIG. 6.

FIG. 7 shows a refinement of the embodiment which is illustrated in the left region of FIG. 6. In this case, only the region of the functional running track is shown in a three-dimensional illustration. A spacing is present between the two adjacent rail elements 11*a* and 11*b* such that the rail elements 11*a* and 11*b* can expand freely in the travel direction 2. Moreover, the mutually opposite borders have a step-shaped profile. Moreover, the mutually opposite borders in the region of the functional running track have a chamfer 73. Alternatively or additionally to the chamfer, a corresponding curvature can also be provided. It is important only that a funnel-shaped profile along the functional running track results. This has the advantage that the abutting edges in the case of a less-than-ideal setting of the rail elements following a pivoting procedure are reduced. For example, a certain offset between the adjacent rail elements, or an incline between adjacent rail elements, may arise.

Figure 8:
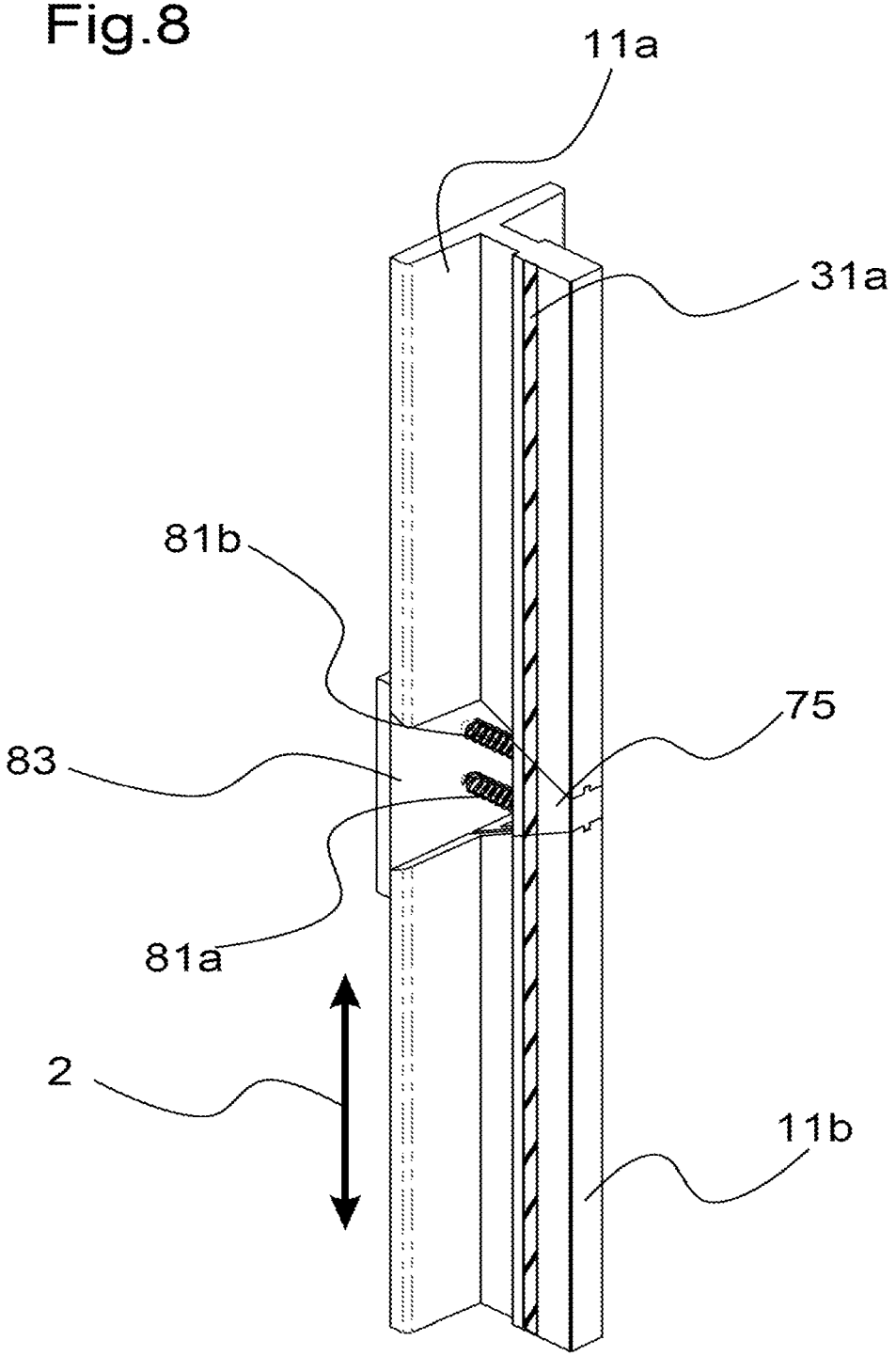
FIG. 8 is a perspective view of another example guide rail.
Figure 9B:
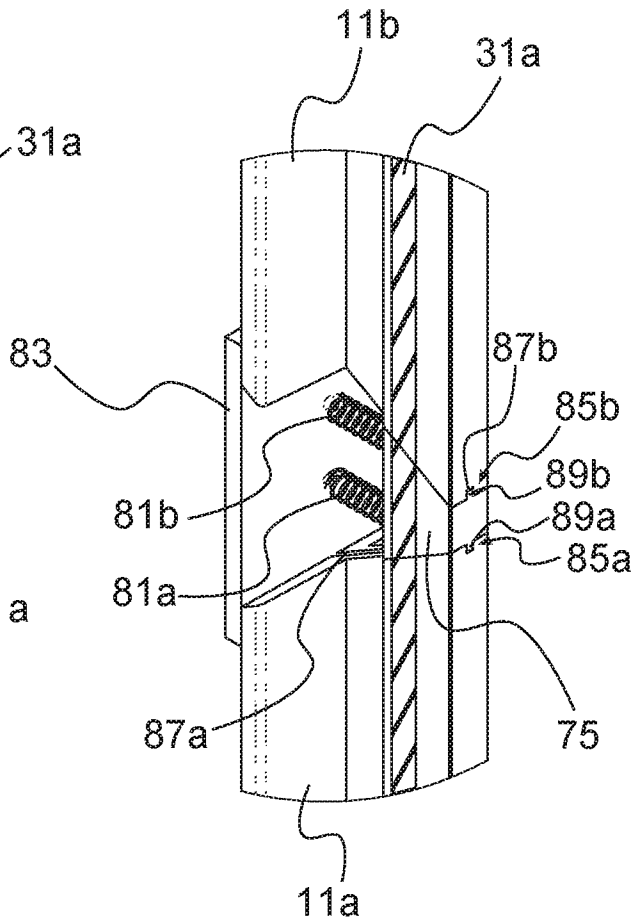
FIG. 9*b* is a perspective view of the example guide rail portion of FIG. 9*a*, with "FIG. 9" referring collectively to FIGS. 9*a* and 9*b*.
Figure 9A:
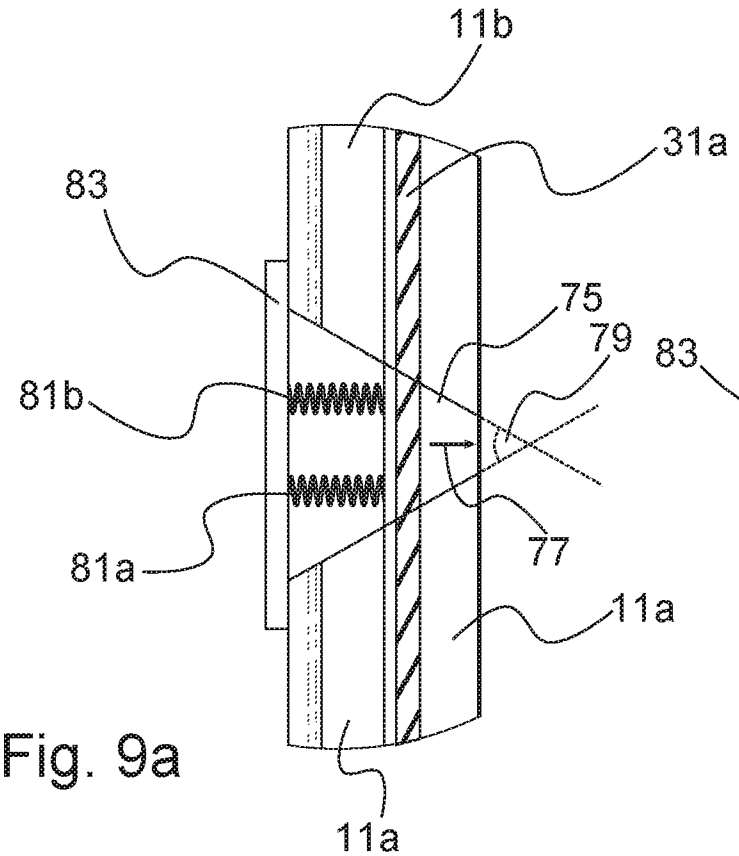
FIG. 9*a* is a front view of an example guide rail portion from the example guide rail of FIG. 8 in a first state at a first temperature.
Figure 10B:
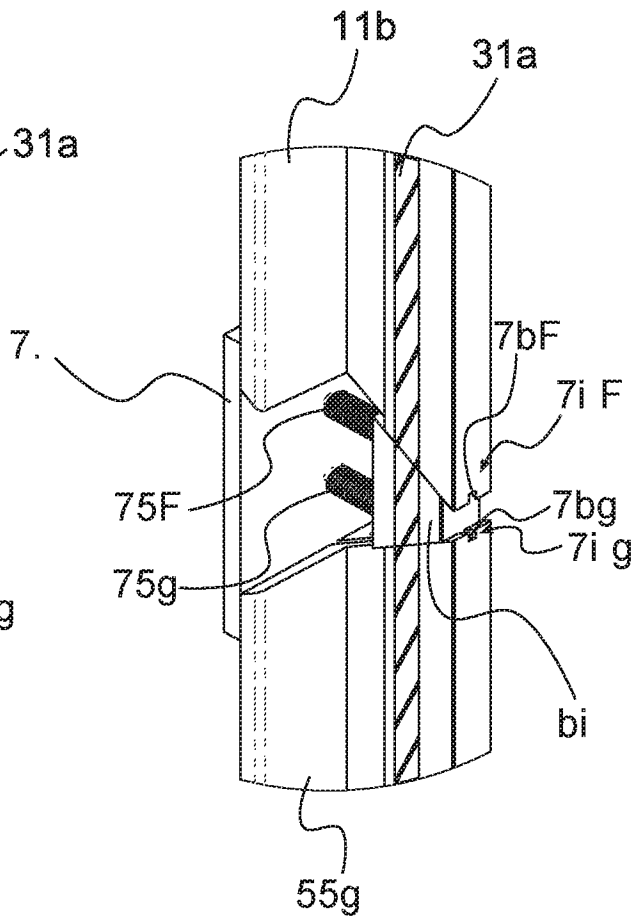
FIG. 10*b* is a perspective view of the example guide rail portion of FIG. 10*a*, with "FIG. 10" referring collectively to FIGS. 10*a* and 10*b*.
Figure 10A:
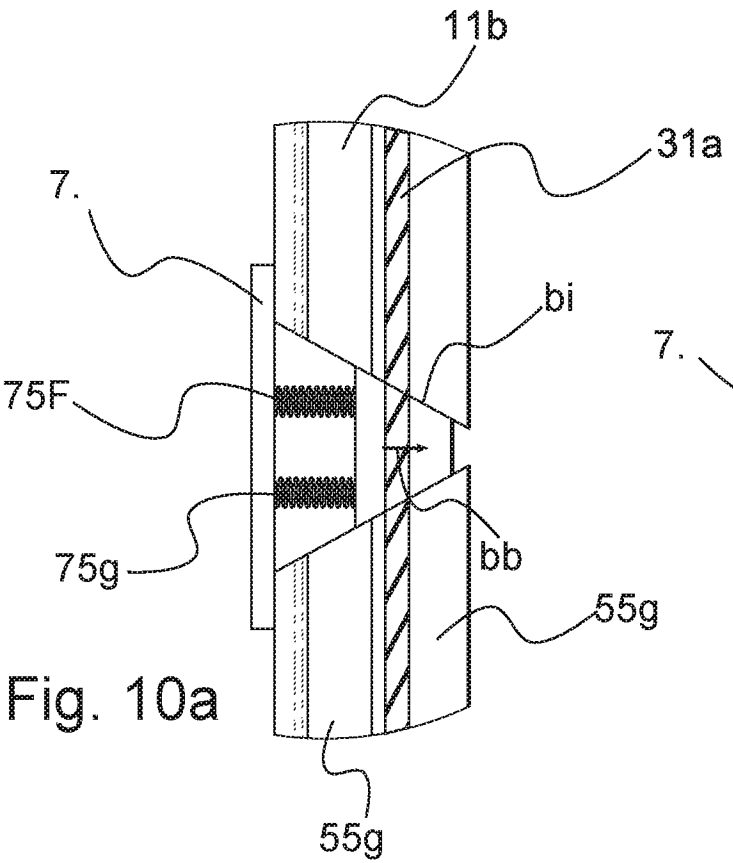
FIG. 10*a* is a front view of the example guide rail portion from the example guide rail of FIG. 8 in a second state.

FIGS. 8, 9, and 10 show a further embodiment of a guide rail according to the invention. FIG. 8 shows a three-dimensional illustration of a guide rail portion 13 thereof. Two rail elements 11*a*, 11*b*, which conjointly form the guide rail portion 13 are shown. The rail elements 11*a* and 11*b* have a mutual spacing such that the rail elements 11*a* and 11*b* can thermally expand freely in the travel direction 2.

The guide rail portion 13 has a functional running track 31*a*. The functional running track 31*a* is a rolling track for a guide roller of an elevator car 7. The same running track is presently also used as a braking track.

The guide rail presently has a T-shaped cross section.

In the absence of respective measures, the spacing between the adjacent rail elements 11*a* and 11*b* leads to an interruption in the functional running track 31*a*. In order for this to be compensated for, a wedge-shaped transition piece 75 is disposed between the two adjacent rail elements 11*a* and 11*b*.

FIGS. 9 and 10 each show enlarged illustrations of the region having the wedge-shaped transition piece 75 in two different states. A three-dimensional view of this region is shown in each case in the right part of FIGS. 9 and 10, while a lateral front view is shown in the left region of FIGS. 9 and 10.

FIG. 9 shows the guide rail portion 13 in a first state at a first temperature. FIG. 10 shows the same guide rail portion 13 in a second state, for example after an increase in temperature. Alternatively, this state can also arise by subsidence of a building, on account of which adjacent rail elements move toward one another.

The functioning of this embodiment will be explained hereunder with reference to FIGS. 8, 9, and 10.

The two adjacent rail elements 11*a* and 11*b* in the region of the functional running track 35 have mutually opposite borders which are rectilinear and enclose an angle in relation to one another. This angle corresponds to the wedge angle 79 of the wedge-shaped transition piece 75. The wedge-shaped transition piece 75 in the region of the functional running track 31 thus fits exactly into the intermediate space between the adjacent rail elements 11*a* and 11*b*. A continuous and consistent face without any gap thus results along the functional running track 31*a* and 31*b*. The functional running track 31*a* extends across the wedge-shaped transition piece 75.

While FIG. 9 shows the guide rail portion 13 in a cold state, the same guide rail portion 13 in FIG. 10 is illustrated after heating (Or before subsidence and after subsidence of the building, respectively). The two adjacent rail elements 11*a* and 11*b* each have thermally expanded in the travel direction such that the spacing between the two rail elements 11*a* and 11*b* has been reduced (transition from FIG. 9 to FIG. 10). Both rail elements 11*a* and 11*b* in the thermal expansion each have exerted a force in a direction parallel with the travel direction on the wedge-shaped transition piece 75. This force has led to the wedge-shaped transition piece 75 in the heated state (FIG. 10) to having been expelled counter to the wedge direction 77. The direction toward the sharp end of the wedge-shaped transition piece 75 is referred to as the wedge direction 77, said direction running along the bisectrix of the wedge angle 79 of the wedge-shaped transition piece 75.

It can be seen by means of FIG. 10 that a continuous and consistent face without a gap is present along the functional running track 31*a* also in the heated state. The exact dimensions of the wedge-shaped transition piece 75 are thus chosen such that the functional running track by way of the entire width thereof bears on the wedge-shaped transition piece 75, independently of whether the wedge-shaped transition piece is inserted (FIG. 9) or is expelled (FIG. 10). The wedge angle 79 is presently 60°. Further wedge angles are also conceivable and possible. Furthermore, the wedge-shaped transition piece 75 is oriented such that the wedge direction 77 runs at an angle of 90° in relation to the travel direction.

In a cooling of the adjacent rail elements 11*a*, 11*b*, the former each thermally contract in the travel direction again, such that the spacing between the two rail elements 11*a* and 11*b* is enlarged again (transition from FIG. 10 to FIG. 9). In order for the wedge-shaped transition piece 75 in this cooling to move back, the wedge-shaped transition piece 75 is mounted so as to be pretensioned counter to the wedge direction 77. The wedge-shaped transition piece 75 is pretensioned counter to the wedge direction 77 with the aid of two compression springs 81*a* and 81*b*.

The compression springs 81*a* and 81*b*, respectively, extend between the blunt end of the wedge-shaped transition piece 75 and a holding installation 83. In the thermal expansion (transition from FIG. 9 to FIG. 10) the wedge-shaped transition piece 75 is expelled counter to the spring force of the compression springs 81*a*, 81*b*. In the thermal contraction (transition from FIG. 10 to FIG. 9) the transition piece 75 is then inserted again with the aid of the spring force of the compression springs 81*a*, 81*b*. The compression springs 81*a* and 81*b* presently are designed and oriented such that the spring force runs parallel with the wedge direction 77.

A guide 85*a* is provided between the transition piece 77 and the rail element 11*a*. The guide 85*a* comprises a groove 87*a* on the rail element 11*a*, a spring 89*a* engaging in said groove 87*a*. The spring 89*a* herein is disposed on the wedge-shaped transition piece 75. Accordingly, a guide 85*b* is provided between the transition piece 77*a* and the rail element 11*b*. The guide 85*b* comprises a groove 87*b* on the rail element 11*b*, a spring 89*b* engaging in said groove 87*b*. The spring 89*b* herein is disposed on the transition piece 77.

The two guides 85*a*, 85*b* ensure that the wedge-shaped transition piece 75 carries out a well-defined translatory movement. A uniform and consistent functional running track 31*a* is thus guaranteed in every position of the wedge-shaped transition piece 75. This applies in particular also to the region of the transition between the rail elements 11*a* and 11*b* and the wedge-shaped transition element 75.

LIST OF REFERENCE SIGNS

Elevator system 1
Travel direction 2
Shaft 3
Shaft wall 5
Elevator car 7
Guide rail 9
Rail elements 11*a, b, c, d, e*
Guide rail portion 13 *a, b, c*
Fixed bearing 15
Loose bearing 17
Linear motor 19
Primary part 21
Secondary part 23
Guide roller 24
First holder 25
Shoe brake 26
Second holder 27
Mount 29
Functional running tracks 31*a, b, c*
Pins 33
Blind bores 35
Cut 37
Transition element 39
Comb-shaped moldings 41
Line 43
First bolt 45
First plates 47
Bore (first plates) 49
Second bolt 51
Second plates 53
Bore (second plates) 55
Elongate bore (first plates) 57
Elongate bore (second plates) 59
Narrow side (first plates) 61
Narrow side (second plates) 63
Reinforcement element 65
Angle 67
Rotation axis 69
Direction 71
Chamfer 73
Wedge-shaped transition piece 75
Wedge direction 77
Wedge angle 79
Compression spring 81*a, b*
Holding installation 83
Guide 85*a, b*
Groove 87*a, b*
Spring 89*a, b*

What is claimed is:

1. A guide rail for an elevator system comprising:

at least two rail elements that together form a guide rail portion having a running track extending in a travel direction, wherein each of the at least two rail elements is connected to a shaft wall of the elevator system, wherein the at least two rail elements are spaced apart such that the at least two rail elements can thermally expand freely in the travel direction;

a wedge-shaped transition piece disposed between the at least two rail elements, wherein the wedge-shaped transition piece is mounted so as to be movable perpendicular to the travel direction; and guides disposed between the wedge-shaped transition piece and the at least two rail elements, wherein each guide comprises a groove and a tongue, wherein the tongues engage the grooves in order to guide the wedge-shaped transition piece between the at least two rail elements perpendicular to the travel direction.

2. The guide rail of claim 1 wherein the at least two rail elements have mutually opposite borders that are rectilinear and enclose an angle that corresponds to an angle of the wedge-shaped transition piece.

3. The guide rail of claim 1 wherein the running track extends across the wedge-shaped transition piece.

4. The guide rail of claim 1 wherein the wedge-shaped transition piece is mounted so as to be pretensioned in a direction of the wedge, wherein the direction of the wedge runs from a blunt end of the wedge-shaped transition piece to a sharp end of the wedge-shaped transition piece.

5. The guide rail of claim 1 further comprising a compression spring that extends between a blunt end of the wedge-shaped transition piece and a holding installation.

6. The guide rail of claim 1 wherein each of the at least two rail elements is connected to the shaft wall by way of at least one fixed bearing and at least one loose bearing such that the at least two rail elements can thermally expand in the travel direction.

7. The guide rail of claim 1 wherein the running track is a rolling track for a guide roller of an elevator car or a braking track for a shoe brake of an elevator car.

8. The guide rail of claim 1 wherein the grooves are disposed on the at least two rail elements.

9. The guide rail of claim 8 wherein the tongues of the guides that engage the grooves are disposed on the wedge-shaped transition piece.

* * * * *